United States Patent [19]

Bell et al.

[11] 4,209,261

[45] Jun. 24, 1980

[54] RIBBON CASSETTE FOR OBLIQUE RIBBON FEEDING

[75] Inventors: David W. Bell, Ithaca; Edward W. Sinram, Cortland, both of N.Y.

[73] Assignee: NCR Corporation, Dayton, Ohio

[21] Appl. No.: 859,401

[22] Filed: Dec. 12, 1977

[51] Int. Cl.[2] ..... B41J 33/10

[52] U.S. Cl. ..... 400/196.1; 400/224; 400/235.1; 400/621

[58] Field of Search ..... 400/194, 195, 196, 196.1, 400/208, 213, 229, 235.1, 613, 621, 224

[56] References Cited

U.S. PATENT DOCUMENTS

| | | | |
|---|---|---|---|
| 2,755,905 | 7/1956 | Segui | 400/196 |
| 3,720,954 | 3/1973 | Czyryk | 400/208 X |
| 3,726,381 | 4/1973 | Murphy | 400/196.1 |
| 3,887,056 | 6/1975 | Lehmann | 400/196 |
| 3,904,017 | 9/1975 | Frechette | 400/196.1 |
| 3,941,231 | 3/1976 | Matuck et al. | 400/196.1 |
| 3,974,906 | 8/1976 | Lee et al. | 400/196.1 |
| 3,977,512 | 8/1976 | Teagarden et al. | 400/195 |
| 3,989,132 | 11/1976 | Carson | 400/195 |
| 4,053,040 | 10/1977 | McGourty | 400/235.1 |

FOREIGN PATENT DOCUMENTS

| | | | |
|---|---|---|---|
| 942746 | 5/1956 | Fed. Rep. of Germany | 400/213 |
| 912319 | 4/1946 | France | 400/213 |

OTHER PUBLICATIONS

IBM Technical Disclosure Bulletin, "Helically Grooved Ribbon Guide", Bakken, vol. 13, No. 8, Jan. 1971, p. 2229.

*Primary Examiner*—Ernest T. Wright, Jr.
*Attorney, Agent, or Firm*—J. T. Cavender; Wilbert Hawk, Jr.; George J. Muckenthaler

[57] ABSTRACT

An operator changeable and disposable ribbon cassette of molded plastic serves as a protective guard and as a part of the cabinetry on a printer and has a built-in tear-off edge for paper. The ribbon, ribbon guides and ribbon drive rollers are angled at two degrees with respect to the line of print wires or line of printing to make better use of the ribbon width, and the cassette includes a ribbon tension spring and a drive pressure spring, the tension spring being used to maintain the endless ribbon in a desired position upon exit from a stuffing box portion of the cassette and the drive pressure spring being a part of the drive roller mechanism for driving the ribbon in a continuous manner. The cassette is connected to the printer framework and includes cam surfaces and latches to hold the cassette in place on the printer.

8 Claims, 5 Drawing Figures

RIBBON CASSETTE FOR OBLIQUE RIBBON FEEDING

BACKGROUND OF THE INVENTION

In the field of inking ribbons, a supply spool and a take-up spool have been provided on opposite sides of a typing or printing station with means for reversing the direction of travel of the ribbon to obtain longer ribbon life. The inking ribbon has usually been made to travel along a line of printing wherein the spools are positioned beyond the ends of the printing line, however in the case of certain printers, a wide ribbon is used and is made to travel in a direction normal to the print line.

In present day printers, it is common practice to use a ribbon cassette carrying an endless ribbon which is caused to be driven past the printing station with the ribbon being either a pre-inked ribbon or a ribbon which is to be continuously or frequently re-inked during the printing operation. The ribbon cassette may be of the stuffing box type, wherein the ribbon is contained within the cassette in random manner and the ribbon is unfolded at the cassette exit and is caused to be driven past the printing station and then trained to enter the cassette to be folded in random manner therein. A ribbon may be utilized in a mobius loop configuration wherein the ribbon is in substantially continuous contact with an inking core or the ribbon may have a plurality of coils around a core for controlled inking thereof.

Representative prior art in ribbon cassettes is shown and described in U.S. Pat. No. 2,755,905 issued to J. Segui on July 24, 1956, which shows an endless ribbon feeding device consisting of a flat case for attachment to the machine and having an inked pad means for rotating the inking pad in a step-by-step method and two return pulleys over which the ribbon passes and which forces the ribbon to surround the inking pad along with a spring for maintaining the tension of the ribbon constant during printing operations.

U.S. Pat. No. 3,887,056 issued to J. H. Lehmann, on June 3, 1975 discloses a demountable pluggable tensioning and re-inking cartridge which includes a plurality of inking rollers operable with a tension roller, the cartridge being removably attached with the frame of associated apparatus. An adjustable self-tensioning means holds the ribbon in a taut condition in a printing position and holds the ribbon in frictional contact with the re-inking members.

U.S. Pat. No. 3,904,017 issued to T. E. Frechette on Sept. 9, 1975 shows a ribbon cassette with a pre-threaded vibrator and ribbon feed means with the ribbon being placed in a stuffing condition in right and left housings.

U.S. Pat. No. 3,941,231 issued to G. C. Matuck et al. on Mar. 2, 1976 discloses a ribbon cartridge for an endless loop ink ribbon wherein the ribbon is in a cartridge which includes elongated guide members to confine the path of the loop of ribbon outside of the cartridge to a predetermined path and to allow for insertion of the cartridge into the machine without the necessity of threading the inked ribbon through fixed guides on the machine. The cartridge is of the stuffing box type, and includes drive rollers at one side of the cartridge and a friction block at the outlet of the cartridge.

U.S. Pat. No. 3,974,906 issued to S. L. Lee et al. on Aug. 17, 1976 shows an endless loop cartridge with random storage and wherein a pair of spaced guide means are used to provide for easy threading in a principal cavity of the cartridge and a secondary cavity prevents a loop of the ribbon from coming out of the cartridge in unsupported manner. A pair of drive rollers receive the ribbon for driving thereof into the principal cavity and a spring is positioned with a surface at the exit end of the cartridge for providing friction on the inked ribbon.

And, U.S. Pat. No. 3,989,132 issued to A. B. Carson on Nov. 2, 1976 shows ribbon storage and transport mechanism wherein a ribbon cartridge includes drive rollers for driving the ribbon into a stuffing box cavity and a plurality of restrictors at the exit end of the cavity prevent the ribbon from jamming at the exit port. One embodiment of the invention includes a single dam positioned to restrict the path of the ribbon and a second embodiment consists of two dams to restrain the ribbon at the exit port. Means are also provided for inputting the ribbon inside the cartridge and to extend the ribbon usefulness and life by presenting two ribbon edges to the print head.

SUMMARY OF THE INVENTION

The present invention relates to printing apparatus and more particularly, to an endless ribbon cassette which is removably connected to the printer cabinet, the cassette carrying the ribbon in stuffing box manner and having exit and entrance ports for travel of the ribbon in a path past the printing station.

The ribbon cassette is made of molded plastic material and acts as a protective guide for the printing apparatus, such cassette being formed to guide the ribbon at an angle relative to the print line past the printing station. The cassette, being a part of the cabinet, provides for independent movement of the print head carriage and the carriage is simplified by reason of supporting the cassette in separate manner. The cassette is formed to provide the entire ribbon path, including the ribbon in the storage chamber and the ribbon portion past the printing station, in a plane at two degrees from the line of printing, and has a paper tear off portion as an integral part thereof.

The cassette includes a ribbon drive roller and a pressure roller for driving the ribbon in continuous manner during the printing operation, such drive roller being formed to mate with a splined drive shaft to provide a simple positive connection for driving the ribbon in continuous operation. Since the drive roller is set at an angle to the line of print, the splines allow a misalignment of the drive shaft relative to the drive roller. A two stage gear train from the print head carriage drive gives the correct rotational speed and location for the splined drive shaft, which eliminates the need for a separate cassette drive motor. The continuous drive to the cassette provides for more even use of the ribbon and permits a more uniform load on the drive motor.

In accordance with the above discussion, the principal object of the present invention is to provide a ribbon cassette as a part of the cabinetry of a printer.

Another object of the present invention is to provide a ribbon cassette for guiding the ribbon in a path at an angle relative to the line of printing.

An additional object of the present invention is to provide a ribbon drive roller and drive means therefor which is simple and positive for driving the ribbon in continuous manner.

A further object of the present invention is to provide a ribbon cassette with a serrated edge for tearing the record paper.

Additional objects and advantages of the present invention will become apparent and fully understood from a reading of the following specification taken together with the annexed drawing.

DESCRIPTION OF THE PREFERRED EMBODIMENT

Figure 1:
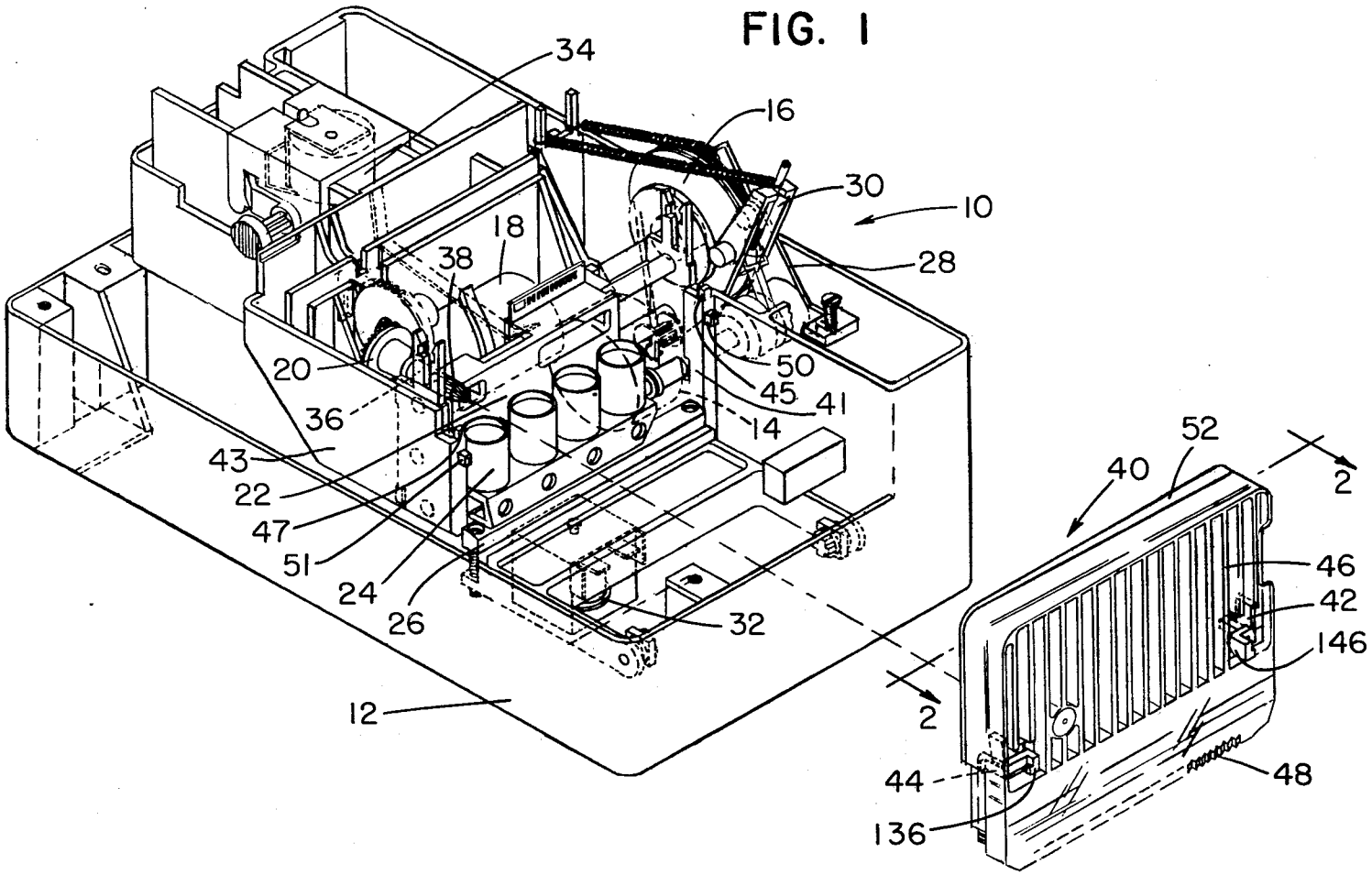
FIG. 1 is a left front perspective view of a matrix printer incorporating the subject matter of the present invention.

Referring now to FIG. 1, there is shown a printer of the matrix type generally designated as 10, the top cover or portion thereof being removed to illustrate certain of the interior working parts which are contained within an enclosure 12 which assumes a rectangular shape and provides protection for a compact high-speed printer. A drive motor 14 is positioned to drive a cluster of gears 16, a drum cam 18, and a bevel gear 20 for driving a ribbon 76 (FIG. 2) in continuous manner past the printing station. The drum cam 18 is continuously driven and provides side-to-side drive or movement for a print carriage 22 which carries a plurality of printing solenoids 24 for printing in a dot matrix manner on printing paper (not shown) or like form which is caused to be moved across a platen 26, such platen 26 being in the shape of a flat bar disposed laterally across the printer 10.

The printing solenoids 24 are positioned about three-quarters of an inch apart and are caused to be moved a distance of approximately one inch during the printing operation, which includes printing in each direction of movement of the print carriage 22. At the end of each line of printing, the paper is caused to be moved by an incremental dot feed arm 28 wherein, in the case of a seven dot height matrix character, the feed arm 28 will advance the paper a total of seven times to complete a line of character printing. A line feed arm 30 provides for advancing the printing paper at a line-to-line spacing which would advance the paper for the next line of characters. A forms compensation solenoid 32 and a form stop solenoid 34 are positioned in appropriate places as shown and for purposes not necessary in the practice of the present invention.

The beveled gear 20 has a drive shaft 36 connected thereto, such shaft 36 including a splined end portion 38 for mating with a drive roller 102 (FIG. 2) in the ribbon cassette, generally designated as 40. The cassette 40 is of molded plastic material and takes the shape of a flat case which, in printing operations, is connected or latched to the printer frame or enclosure 12 by means of latches 42 and 44, which latches 42 and 44 are an integral part of the cassette 40 and which secure to latch projections 45 and 47 on side plates 41, 43 of the printer frame 12 so that the cassette 40 is positioned to cover the front portion of the print carriage 22 and wherein the ribbon 76 is caused to be driven in a path above the platen 26 so that print wires (not shown) of the solenoids 24 impact against the ribbon 76 and the paper in a printing operation. The lower portion of the cassette 40 is used to enclose the four solenoids 24 as they move in a reciprocating manner with the carriage 22. The cassette 40 includes the side portions or walls 62, 64 which make up a rectangular box for containing the ribbon 76 and also includes a ribbed front portion 46 and a serrated edge 48 at the bottom side thereof for tearing the paper after printing thereon.

Figure 2:
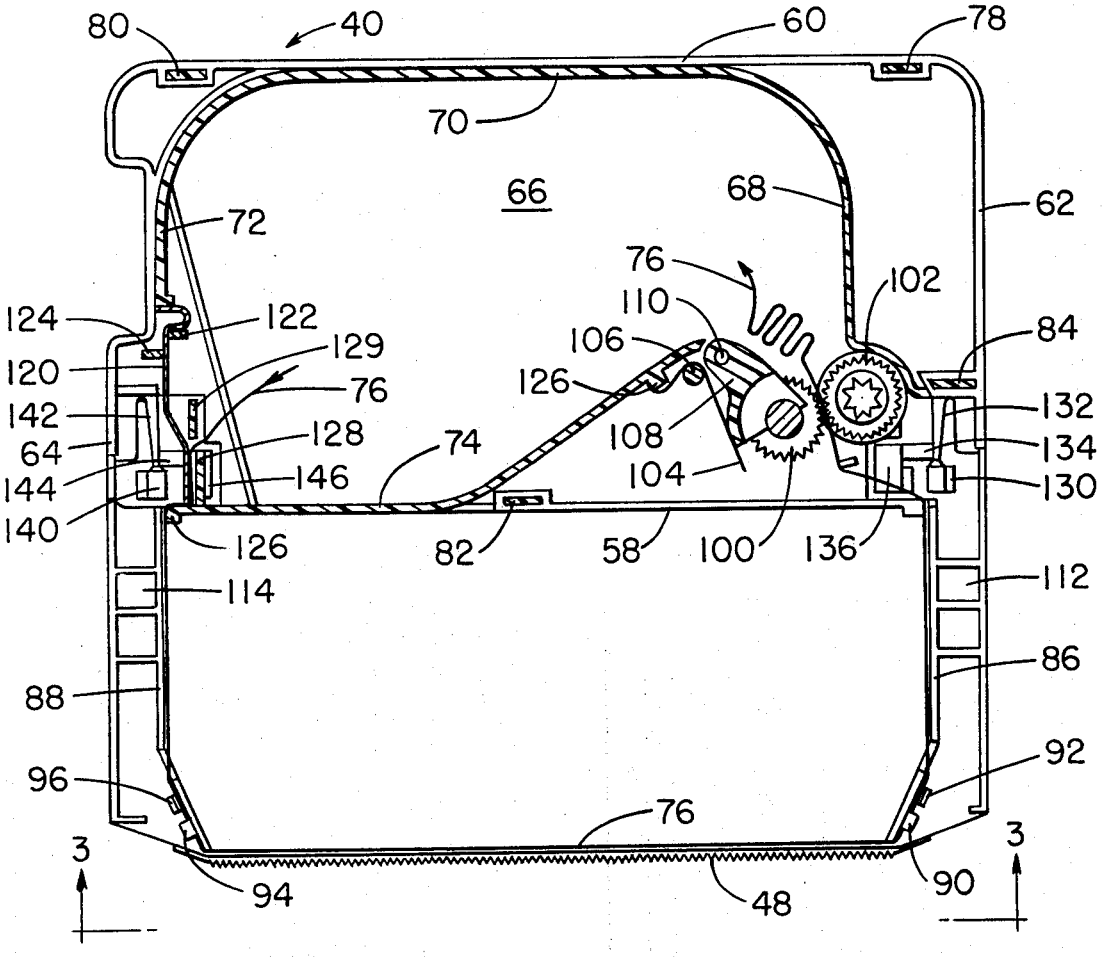
FIG. 2 is a view, partly in section, taken on the plane 2—2 of FIG. 1 and having the rear cover of the cassette removed.
Figure 3:
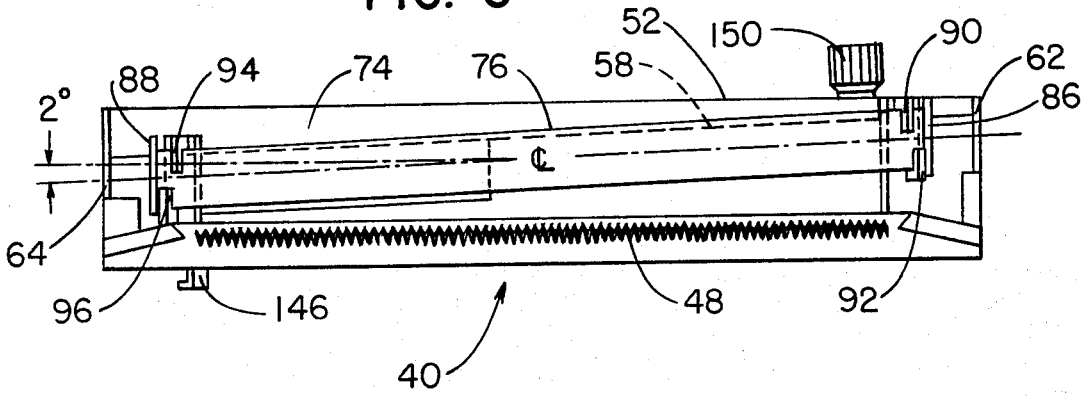
FIG. 3 is a bottom view taken along the plane 3—3 of FIG. 2.

FIG. 2 shows a rear view of the cassette 40 with the back cover 52 (FIG. 3) removed therefrom so as to show the several parts of the cassette 40 and the path of ribbon travel therethrough. The cassette 40 has an outside wall 60 on the top side thereof, the right hand wall 62 and the left hand wall 64, as seen in FIG. 2, which as mentioned, is a rear view of the cassette 40 as seen in FIG. 1. A cavity 66 is formed by the walls 68, 70, 72 and 74 in a manner to contain an endless ribbon 76 which is shown to be driven in a path as indicated by the direction of the ribbon arrows. The walls 60, 62, and 64 are a portion of the front part of the cassette 40, whereas the walls 68, 70, 72 and 74 are a part of the back cover 52 and which form the cavity 66. The back cover 52 is connected and locked to the front portion of the cassette 40 by means of lugs 78, 80, 82 and 84 which fit in slots in the front portion of the cassette 40. A pair of walls 86 and 88 provide guides for the ribbon 76 as it is driven in a path past the printing station. The portion of the cassette 40 formed by the walls 74, 58, 86, and 88 provides a three-sided enclosure for the solenoids 24 with the ribbon 76 running along the lower open end of the cassette 40. As seen in FIG. 3, a pair of lugs 90 and 92 on the right side and a pair of lugs 94 and 96 on the left side also contain the ribbon 76 in its path past the printing area, the ribbon 76 being shown in the inclined attitude that it takes in the cavity 66.

A pair of identical rollers 100 and 102 are positioned to cooperate with each other in driving the ribbon 76 at the entrance end of the cavity 66 with roller 100 being the driving roller which is pressured against the roller 102 by means of a spring 104. The spring 104 is positioned around a stud 106 secured to the back cover 52 and a plastic arm 108 is pivoted on a pin 110 secured to the same cover 52. The plastic arm 108 has secured thereto, as an integral part thereof, a plurality of stripper bearings 172, 174 which are positioned between the several driving portions of the wheel 100 which will be more fully described. A ribbon tension spring 120 is positioned about a stud 122 also fixed to the back cover 52 and abuts against a finger 124 and an end portion 126 of the cover 52, which end portion 126 is an extension of the wall 74.

The cassette body also includes a pair of locating recesses or wells 112 and 114 adjacent the three-sided enclosure which recesses 112 and 114 engage with projections 50 and 51, as seen in FIG. 1, to position and hold the cassette 40 on the frame 12 of the printer 10.

A pair of projecting portions 128 and 129 additionally provide positioning means for the spring 120 and also a path for the ribbon 76 to follow from the cavity portion 66 of the cassette 40 past the spring 120 and toward the printing station.

Means is provided for operator removal of the cassette 40 from the printer frame 12 and includes a latch portion 130 which engages with the projection 47, as seen in FIG. 1. The latch portion 130 is supported from a cantilever spring portion 132 which is secured to the body portion of the cassette 40. An arm 134 is an integral part of the spring portion 132 and has attached thereto a small lever 136 which is manipulated by the operator to disengage the latch portion 130 from the projection 47. A like latch portion 140 on the left-hand side of the cassette 40 in FIG. 2 is supported from a cantilever spring portion 142 which has an arm 144 extending therefrom and to which is secured a small lever 146 for operation to disconnect the latch portion 140 from the projection 45 on the printer frame 12.

The serrated edge 48, as an integral part of the body of the cassette 40, is positioned along the lower edge or side of the cassette 40, FIGS. 1 and 2, and provides a simple tear-off edge 48 for the paper, the edge 48 being maintained in position with the paper by reason of the cassette 40 being attached to the frame 12 of the printer 10. The molded tear-off edge 48 is new with each new cassette 40 and wearing of the edge 48 by the paper is no problem, in addition to eliminating the need for a separate tear-off blade.

Figure 4:
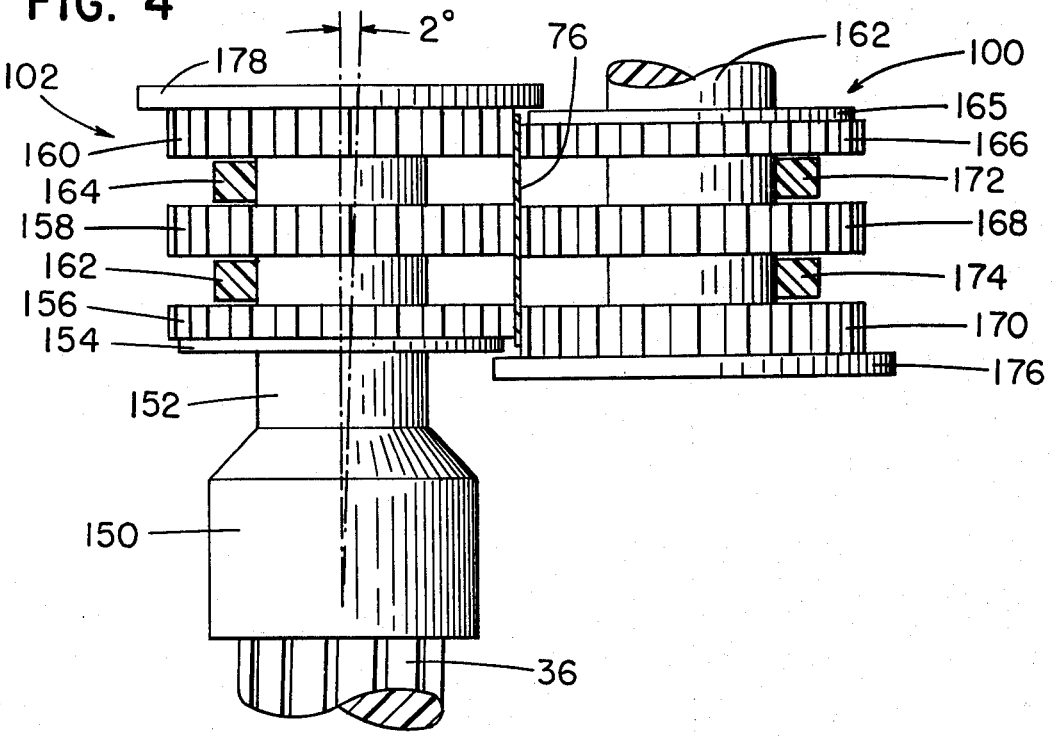
FIG. 4 is an enlarged view of the ribbon drive rollers and the driving connection therefor.

In FIG. 4 is shown an enlarged view of the drive rollers or wheels 100 and 102 for driving the ribbon 76 therebetween, each of the drive wheels 100 and 102 being identical in form but reversed in position to provide a driving connection with the splined shaft 36 and also to provide a meshing of the gear teeth portions 156, 158, 160 of the drive wheels 100 and 102 while providing a flange 154 and a flange 165 on each side of the ribbon 76. The drive wheel 102 includes a knurled portion 150 which has splines (not shown) therein for accommodating the splined end portion 38 of the shaft 36. A shank portion 152 of the drive wheel 102 carries the flange 154, with the drive wheel teeth portions 156, 158 and 160 separated by the stripper bearings 162 and 164 which partially surround the shank portion 152 of the drive wheel 102 and thereby position and separate the gear teeth portions 156, 158, 160 of the drive wheel 102. While the centerline of the drive shaft 36 is aligned with the printer frame 12 and normal to the centerline of the cam drive roller 18, the ribbon drive roller 102 is angled at two degrees from the drive shaft 36. The drive wheel or roller 100 as mentioned above is identical with drive wheel 102 and includes a shank portion 162 carrying a flange 165 and the drive gear portions 166, 168, and 170 with the stripper bearings 172 and 174 therebetween. A flange 176 and a flange 178 constitute the end portions of the drive wheels 100 and 102 and maintain the ribbon 76 in a straight path when it is driven into the cavity 66 of the cassette 40.

Figure 5:
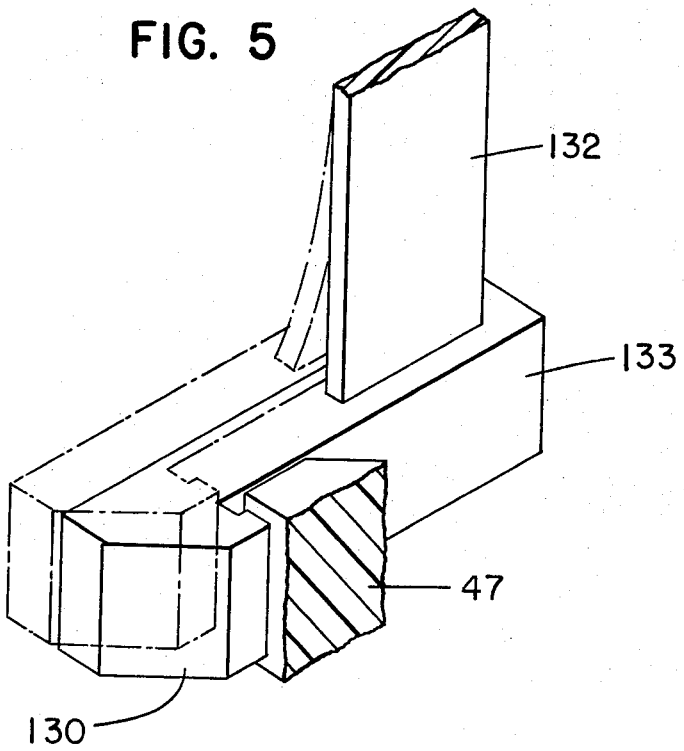
FIG. 5 is an enlarged perspective view of the means for latching the ribbon cassette on the printer cabinet.

In FIG. 5 is shown an enlarged view of the spring latch portion 130 which enables removing of the cassette 40 from the printer frame 12 and includes the cantilever spring portion 132, being the right hand latch portion 130 as seen in FIG. 2. The spring portion 132 has secured thereto the latch portion 130 for engaging with the lug 47 of the printer frame 12, the latch portion 130 being an integral part of a connecting member 133 which also carries the lever 136, not seen in FIG. 5. When the cassette 40 is to be removed from the printer frame 12, the operator moves the lever 136 of the latch 44 and the lever 146 of the latch 42 to disengage the latch portion 130 and the latch portion 140 from the respective lugs 47 and 45 on the printer frame 12. The surface of latch portion 130 is a cam surface to match with a cam surface of the projection 47.

It is thus seen that herein shown and described is a ribbon cassette which is removable from the printer and which provides space for movement of the print heads back and forth across the printer and wherein the ribbon is caused to be driven in a path from a cavity of the cassette at an angle past the printing station by means of the driving wheels which are a portion of the cassette. The cassette is supported independent of movement of the print head carriage or assembly and the drive rollers receive motion in continuous manner from the carriage drive mechanism. The cassette as shown and described enables the accomplishment of the objects and advantages mentioned above and while one embodiment of the invention has been disclosed herein, variations thereof beyond those herein mentioned may occur to those skilled in the art. It is contemplated that all such variations not departing from the spirit and scope of the invention hereof are to be construed in accordance with the following claims.

What is claimed is:

1. A cassette for an endless ribbon on a printer having a plurality of spaced printing solenoids and means for driving said printing solenoids in side to side movement across said paper, comprising a
   - body portion having a cavity for containing said ribbon in random manner,
   - roller means positioned at an oblique angle relative to said body portion and to a line of printing and connected with said means for driving said printing solenoids for continuously driving said ribbon into and out of said cavity and along a path at said angle relative to the line of printing,
   - means for containing said ribbon in said angular path relative to said line of printing, and
   - means removably connecting said cassette to said printer for permitting printing by said printing solenoids along said line of printing independent of the position of the cassette on said printer.

2. The cassette of claim 1 wherein said means for containing comprise a pair of projections on each side of said body portion for maintaining said ribbon at said angle to said line of printing.

3. The cassette of claim 1 wherein said removably connecting means comprise a pair of latch members integral with said body portion for connecting thereof to said printer and said cassette includes a tear-off edge along one side thereof.

4. Means for driving an endless ribbon carried in a body portion of a cassette along a line of printing on a printer having printing solenoids and means for driving said printing solenoids in reciprocating manner across said printer, comprising a
   - pair of drive rollers operable with each other for driving said ribbon therebetween, said drive rollers being carried by said cassette on axes positioned at an oblique angle relative to said body portion and to said line of printing for causing an angled path of said ribbon relative to said line of printing,
   - means on said cassette for containing said ribbon in said angular path relative to said line of printing, and a
   - drive member connected with said means for driving said printing solenoids and engageable with one of said drive rollers for continuous driving thereof during reciprocation of said printing solenoids.

5. The subject matter of claim 4 wherein each of said drive rollers includes a plurality of driving portions for distributing the driving force on said ribbon.

6. In a printer having a plurality of equally spaced printing solenoids reciprocable thereacross and means for driving said printing solenoids in continuous manner along a line of printing, a ribbon cassette having a body portion forming a portion of and carried by said printer and containing an endless ribbon, a drive shaft connected with said means for driving said printing solenoids and positioned normal to said line of printing, a pair of drive rollers carried by said cassette at an oblique angle relative to said body portion and to said line of printing and connected with said drive shaft for driving said endless ribbon in continuous manner past the line of printing, the axes of said drive rollers defining an angle with respect to the axis of said drive shaft and to said line of printing, whereby said ribbon is caused to be directed by said drive rollers along a path at said angle relative to said line of printing, means for containing said ribbon in said angular path relative to said line of printing, and means removably connecting said cassette with said printer permitting movement of said printing solenoids for printing thereby independent of the position of said cassette on said printer.

7. In the printer of claim 6 wherein said means for containing said ribbon comprise a pair of projections at the exit and at the entrance end of said cassette for maintaining said ribbon along the angle of said path.

8. In the printer of claim 6 wherein said cassette includes a tear-off edge integral therewith.

* * * * *